US009424795B2

(12) United States Patent
Saitoh et al.

(10) Patent No.: US 9,424,795 B2
(45) Date of Patent: Aug. 23, 2016

(54) DISPLAY DEVICE, AND DRIVING METHOD

(75) Inventors: Kohji Saitoh, Osaka (JP); Masaki Uehata, Osaka (JP); Asahi Yamato, Osaka (JP); Masami Ozaki, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 106 days.

(21) Appl. No.: 14/008,582

(22) PCT Filed: Apr. 3, 2012

(86) PCT No.: PCT/JP2012/059041

§ 371 (c)(1),
(2), (4) Date: Sep. 30, 2013

(87) PCT Pub. No.: WO2012/137761

PCT Pub. Date: Oct. 11, 2012

(65) Prior Publication Data

US 2014/0022231 A1 Jan. 23, 2014

(30) Foreign Application Priority Data

Apr. 7, 2011 (JP) ..... 2011-085817

(51) Int. Cl.
*G09G 3/36* (2006.01)

(52) U.S. Cl.
CPC ..... *G09G 3/3674* (2013.01); *G09G 3/3648* (2013.01); *G09G 3/3688* (2013.01)

(58) Field of Classification Search
CPC ..... G09G 2330/021; G09G 2330/02; G09G 2310/0213; G09G 3/3674; G09G 3/3677; G09G 3/3681; G09G 3/3266
See application file for complete search history.

(56) References Cited

U.S. PATENT DOCUMENTS 5,712,652 A 1/1998 Sato et al.
6,023,260 A * 2/2000 Higashi ..... G09G 3/2011 345/100

(Continued)

FOREIGN PATENT DOCUMENTS

JP 08-286170 A 11/1996
JP 11-249626 A 9/1999

(Continued)

OTHER PUBLICATIONS

Texas Instrument, LM6310 High Speed Low Power Operational Amplifier with Tri-State(RM) Output, 2011.*

(Continued)

*Primary Examiner* — Quan-Zhen Wang
*Assistant Examiner* — Dong Hui Liang
(74) *Attorney, Agent, or Firm* — Keating & Bennett, LLP

(57) ABSTRACT

A display device (1) includes: a scan line drive circuit (4) which line-sequentially selects from among a plurality of scan signal lines; at least one signal line drive circuit (3) which has a receiving circuit that receives a data signal, and which sequentially supplies the data signal to pixels linked to a scan signal line (6) selected by the scan line drive circuit (4); a timing controller (10) which defines, in accordance with sync signals received from an outside source, a non-scan period during which none of the scan signal lines is selected, and which transmits, to the at least one signal line drive circuit (3), an operation discriminant signal that causes the receiving circuit to be underrun during at least part of the non-scan period thus defined. The at least one signal line drive circuit (3) and the timing controller (10) are provided as separate entities.

14 Claims, 11 Drawing Sheets

(56) References Cited

U.S. PATENT DOCUMENTS

| | | | | |
|---|---|---|---|---|
| 2002/0180673 | A1 | 12/2002 | Tsuda et al. | |
| 2004/0227716 | A1* | 11/2004 | Lin | G09G 3/3648 345/99 |
| 2006/0187176 | A1* | 8/2006 | Yang | G09G 3/3659 345/100 |
| 2008/0225033 | A1* | 9/2008 | Hector | G09G 3/3666 345/211 |
| 2008/0297500 | A1 | 12/2008 | Kato | |

FOREIGN PATENT DOCUMENTS

| | | | | |
|---|---|---|---|---|
| JP | 2000-181584 | A | | 6/2000 |
| JP | 2001-312253 | A | | 11/2001 |
| JP | 2003-233351 | A | | 8/2003 |
| JP | 2004-021096 | A | | 1/2004 |
| JP | 2006-133673 | A | | 5/2006 |
| JP | 2006133673 | A | * | 5/2006 |
| JP | 2006-227104 | A | | 8/2006 |
| JP | 2008-298997 | A | | 12/2008 |
| JP | 2009-251524 | A | | 10/2009 |
| JP | 2009251524 | A | * | 10/2009 |

OTHER PUBLICATIONS

Official Communication issued in International Patent Application No. PCT/JP2012/059041, mailed on May 15, 2012.

* cited by examiner

DISPLAY DEVICE, AND DRIVING METHOD

TECHNICAL FIELD

The present invention relates to a display device that can reduce power consumption and a method for driving such a display device.

BACKGROUND ART

In recent years, thin, lightweight, and low-power-consumption display devices, such as liquid crystal display devices, have been actively used. These display devices have been mounted prominently in mobile phones, smartphones, or laptop personal computers. Further, it is expected that in the future, there will be rapid advancements in the development and spread of electronic paper, which is a thinner display device. Under such circumstances, the current common issue is to reduce amounts of electric power that are consumed by various display devices.

For example, Patent Literature 1 discloses a method for driving a display device. This method achieves low power consumption by setting up a non-scan period that is longer a scan period during which the screen is scanned once, i.e., a pause period during which all of the scan signal lines are in a non-scan state.

CITATION LIST

Patent Literature 1

Japanese Patent Application Publication, Tokukai, No. 2001-312253 (Publication Date: Nov. 9, 2001)

SUMMARY OF INVENTION

Technical Problem

Meanwhile, due to an increase in size, a display device of medium size or lager is generally configured such that a signal line drive circuit (source driver) and a timing controller are mounted on separate chips and the signal lines drive circuit comprises a plurality of signal line drive circuits. The term "signal line drive circuit" here means a circuit that supplies image data (video data) to each pixel linked to a scan signal line, and the term "timing controller" here means a circuit that, in accordance with clock signals and sync signals, outputs, to circuits of the display device, such as the signal line drive circuits, signals on the basis of which the circuits operate in synchronization with each other.

Since each of the signal line drive circuits and the timing controller are mounted on separate chips, each of the signal line drive circuits includes a receiving circuit that receives an image data signal from the timing controller.

Since such a display device of medium size or larger is beyond the scope of assumption of the invention described in Patent Literature 1, it is difficult to apply the technical idea described in Patent Literature 1 directly to a display device of medium size or lager to achieve a low-power-consumption display device of medium size or lager.

The present invention has been made in order to solve the foregoing problems, and it is an object of the present invention to provide a display device in which a timing controller and a signal line drive circuit are provided as separate entities and which can reduce power consumption.

Solution to Problem

In order to solve the foregoing problems, a display device according to the present invention includes: a scan line drive circuit which line-sequentially selects from among a plurality of scan signal lines; at least one signal line drive circuit which has a receiving circuit that receives a data signal, and which sequentially supplies the data signal to pixels linked to a scan signal line selected by the scan line drive circuit; a timing control section which defines, in accordance with sync signals received from an outside source, a non-scan period during which none of the scan signal lines is selected, and which transmits, to the at least one signal line drive circuit, a pause control signal that causes the receiving circuit to be underrun during at least part of the non-scan period thus defined, the at least one signal line drive circuit and the timing control section being provided as separate entities.

In order to solve the foregoing problems, a method for driving a display device according to the present invention is a method for driving a display device including: a scan line drive circuit which line-sequentially selects from among a plurality of scan signal lines; at least one signal line drive circuit which has a receiving circuit that receives a data signal, and which sequentially supplies the data signal to pixels linked to a scan signal line selected by the scan line drive circuit; a timing control section which defines, in accordance with clock and sync signals received from an outside source, a non-scan period during which none of the scan signal lines is selected, the at least one signal line drive circuit and the timing control section being provided as separate entities, the method including: (a) a defining step in which the timing control section defines the non-scan period in accordance with the clock and sync signals received from the outside source; and (b) a transmitting step in which the timing control section transmits, to the at least one signal line drive circuit, a pause control signal that causes the receiving circuit to be underrun during at least part of the non-scan period defined in the defining step.

According to the foregoing configuration, the at least one signal line drive circuit has a receiving circuit that receives a data signal. The at least one signal line drive circuit has the receiving circuit because the at least one signal line drive circuit and the timing control section are provided as separate entities.

The timing control section defines the non-scan period in accordance with the clock and sync signals received from the outside source. The non-scan period is a period during which none of the scan signal lines is selected. Then, the timing control section transmits, to the at least one signal line drive circuit, a pause control signal that causes the receiving circuit to be underrun during at least part of the non-scan period thus defined.

This makes it possible to, in the display device in which the at least one signal line drive circuit and the timing control section are provided as separate entities, cause the receiving circuit of the at least one signal line drive circuit to be underrun during at least part of the non-scan period, thus making it possible to reduce power consumption. The phrase "causing a circuit to be underrun" here means restricting the function of the circuit, causing the circuit not to do as well at driving as it could do if it did to the fullest capacity, causing the circuit to stop running, etc.

Advantageous Effects of Invention

As described above, a display device according to the present invention includes: a scan line drive circuit which line-sequentially selects from among a plurality of scan signal lines; at least one signal line drive circuit which has a receiving circuit that receives a data signal, and which sequentially supplies the data signal to pixels linked to a scan signal line selected by the scan line drive circuit; a timing control section which defines, in accordance with sync signals received from an outside source, a non-scan period during which none of the scan signal lines is selected, and which transmits, to the at least one signal line drive circuit, a pause control signal that causes the receiving circuit to be underrun during at least part of the non-scan period thus defined, the at least one signal line drive circuit and the timing control section being provided as separate entities.

A method for driving a display device according to the present invention is a method for driving a display device including: a scan line drive circuit which line-sequentially selects from among a plurality of scan signal lines; at least one signal line drive circuit which has a receiving circuit that receives a data signal, and which sequentially supplies the data signal to pixels linked to a scan signal line selected by the scan line drive circuit; a timing control section which defines, in accordance with clock and sync signals received from an outside source, a non-scan period during which none of the scan signal lines is selected, the at least one signal line drive circuit and the timing control section being provided as separate entities, the method including: (a) a defining step in which the timing control section defines the non-scan period in accordance with the clock and sync signals received from the outside source; and (b) a transmitting step in which the timing control section transmits, to the at least one signal line drive circuit, a pause control signal that causes the receiving circuit to be underrun during at least part of the non-scan period defined in the defining step.

This brings about an effect of making it possible to, in the display device in which the at least one signal line drive circuit and the timing control section are provided as separate entities, cause the receiving circuit of the at least one signal line drive circuit to be underrun during at least part of the non-scan period, thus making it possible to reduce power consumption.

DESCRIPTION OF EMBODIMENTS

[Embodiment 1]

Figure 1:
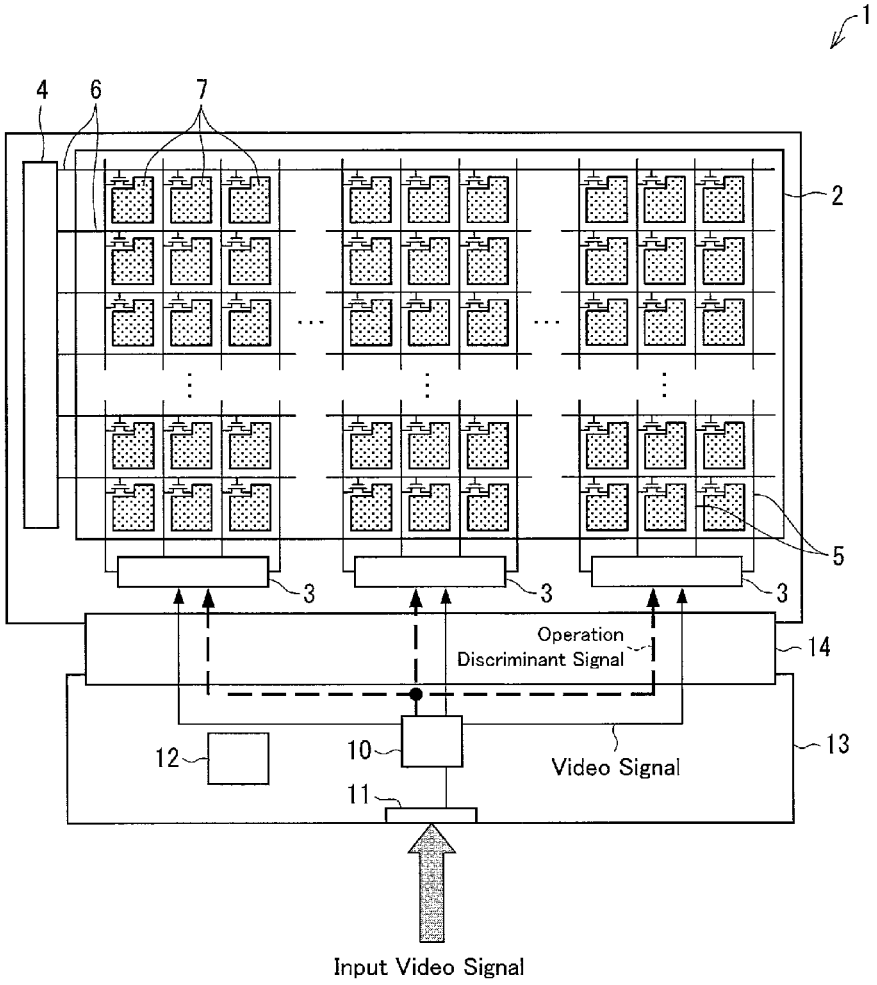
FIG. 1 is a drawing showing an overall configuration of a display device according to an embodiment of the present invention.

An embodiment of the present invention is described below with reference to FIGS. 1 through 3.

(Configuration of a Display Device 1)

First, a configuration of a display device (liquid crystal display device) 1 according to the present embodiment is described with reference to FIG. 1. FIG. 1 is a diagram showing an overall configuration of the display device 1. As shown in FIG. 1, the display device 1 includes a display panel 2, three signal line drive circuits (source drivers) 3, a scan line drive circuit (gate driver) 4, a timing controller (timing control section) 10, an input connector 11, and a power supply generation circuit 12.

The present embodiment assumes that the display device 1 is a liquid crystal display device which employs an a-SiTFT panel of medium size or larger (of a class of 5 to 13 in) and that the resolution is, for example, 1024 RGB×768. In general, in the case of such a class of display device, a signal line drive circuit and a timing controller are mounted on separate chips. In most of such cases, the display device 1 is configured to include three signal line drive circuits 3 and one timing controller 10. In the present embodiment, the display device 1 is configured to include three signal line drive circuits 3. However, the number of signal line drive circuits 3 is not particularly limited.

Further, the resolution of the display device 1 is not limited to the aforementioned resolution, and may be a normal resolution of VGA (640×480) to WXGA (1366×800) or a high resolution of 1920×1024. Further, a display device of the present invention is not limited to a liquid crystal display device, and may be another type of display device such as an organic EL (electroluminescent) display device. Since an organic EL display device consumes a very large electric current during a scan period, a profound effect of lowering electric power is brought about by applying the present invention.

(Display Panel 2)

The display panel 2 includes: a screen composed of a plurality of pixels 7 arranged in a matrix manner; scan signal lines 6 (gate lines); and data signal lines 5 (source lines). The scan signal lines 6 are signal lines that are selected line-sequentially so that the screen is scanned. The data signal lines 5 are signal lines through each of which a data signal is supplied to a single row of pixels 7 included in a selected scan signal line. The scan signal lines 6 and the data signal lines 5 intersect each other.

Each of the signal line drive circuits 3 supplies a data signal to a single row of pixels 7 through a plurality of data signal lines 5. It should be noted that the number of data signal lines that are connected to each of the plurality of signal line drive circuits 3 is not particularly limited.

It should be noted that for simplicity of explanation, the present embodiment takes, as an example, driving targeted at an equivalent circuit, and each of the pixels in the display panel 2 is provided with a TFT (thin-film transistor) having its drain electrode connected to a pixel electrode.

Furthermore, the display device 1 includes a common electrode (COM: not illustrated) for each of the pixels 7 in the screen. The common electrode is driven by a predetermined voltage being outputted to the common electrode in accordance with a polarity reversal signal.

(Scan Line Drive Circuit 4)

The scan line drive circuit 4 selects (scans) from among the plurality of scan signal lines 6 line-sequentially from top to bottom of the screen in accordance with sync and clock signals outputted from the timing controller 10. In so doing, the scan line drive circuit 4 outputs, to each of the scan signal lines 6, a rectangular wave (scan signal) for turning on the switching elements (TFTs) provided in the pixels 7 and connected to the pixel electrodes. This places a signal row of pixels 7 in the screen in a selected state. In this way, the sync signals and the clock signals function as timing control signals to control the timing of output of a scan signal to the display panel 2.

(Signal Line Drive Circuit 3)

Each of the signal line drive circuits 3 calculates, in accordance with sync and clock signals outputted from the timing controller 10, the value of a voltage that is to be outputted to each of the pixels 7 of a single row selected by the scan line drive circuit 4, and outputs a voltage of that value to each of the data signal lines 5. As a result, video data (data signal) transferred from the timing controller 10 is supplied in sequence to each of the pixels 7 linked to (electrically connected to) a selected scan signal line 6. In this way, the sync signals and the clock signals function as timing control signals to control the timing of output of video data to the display panel 2.

Figure 2:
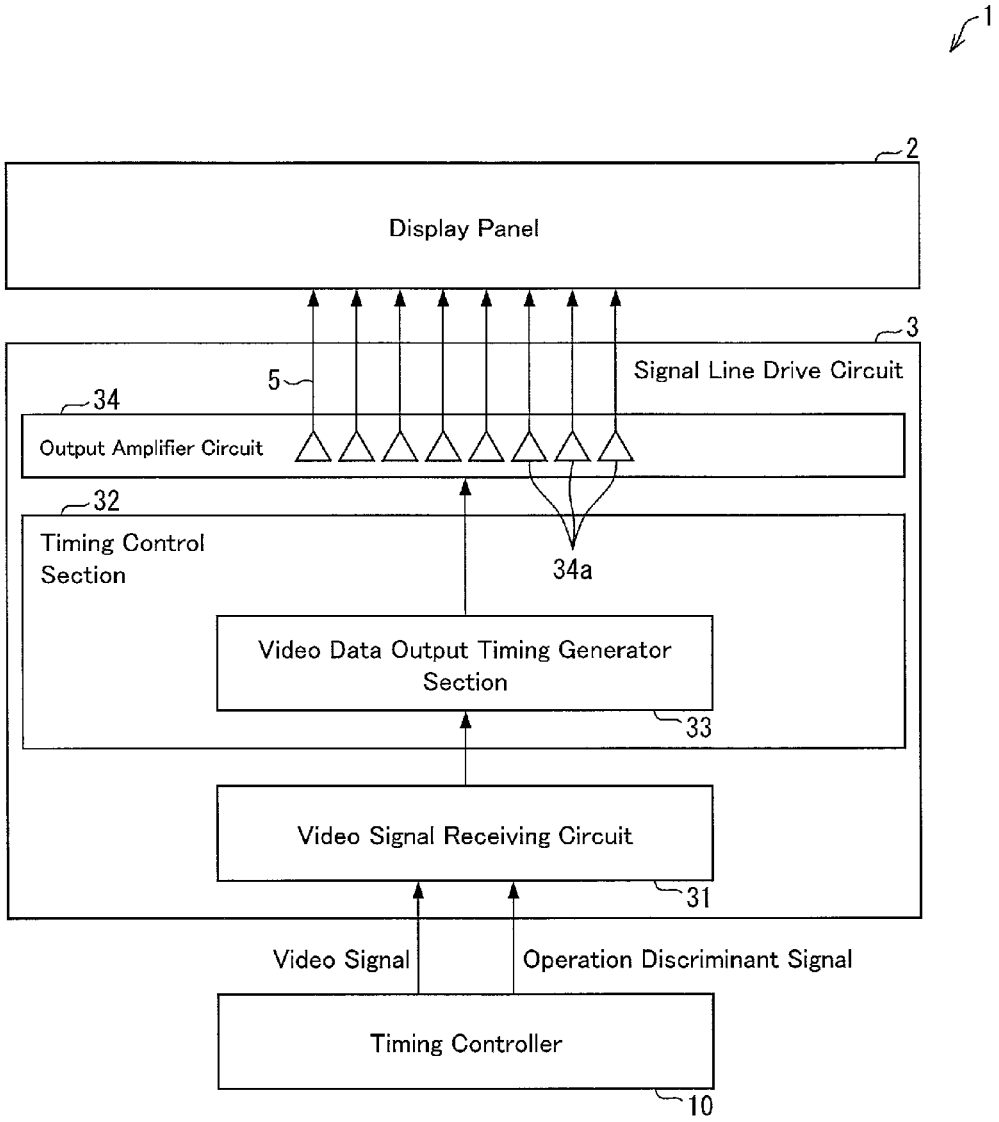
FIG. 2 is a diagram showing a configuration of a signal line drive circuit of the display device.

FIG. 2 is a diagram showing a configuration of each of the signal line drive circuits 3. As shown in FIG. 2, each of the signal line drive circuits 3 includes: a video signal receiving circuit (video data I/F receiving circuit) 31; a timing control section 32 including a video data output timing generator section 33; and an output amplifier circuit (output circuit) 34.

The video signal receiving circuit 31 receives a video signal (data signal) and the after-mentioned operation discriminant signal from the timing controller 10. A possible utilizable example of an interface that receives a video signal is a miniLVDS (low voltage differential signaling) interface or an RSDS (reduced swing differential signaling). However, the interface that is used in the display device 1 is not limited to these examples.

Further, in accordance with the operation discriminant signal outputted from the timing controller 10, the video signal receiving circuit 31 switches between a pause state in which the video signal receiving circuit 31 is underrun and an operating state to which the video signal receiving circuit 31 recovers from the pause state.

The timing control section 32 serves to control the timing of supply of video data from the output amplifier circuit 34 to the display panel 2, and includes the video data output timing generating section 33.

The video data output timing generator section 33 generates, in accordance with sync signals (vertical sync signal and horizontal sync signal) and clock signals that are contained in the video signal received by the video signal receiving circuit 31, control signals (such as a source start pulse signal) in accordance with which the output amplifier circuit 34 is controlled. Then, the video data output timing generator section 33 outputs the control signals thus generated to the output amplifier circuit 34, together with the video data received from the video signal receiving circuit 31.

The output amplifier circuit 34 incudes a plurality of analog amplifiers 34*a* that output the data signal to the respective data signal lines 5. Moreover, the output amplifier circuit 34 supplies the data signal (video data) through each of the analog amplifiers 34*a* to each of the pixels 7 linked to a scan signal line 6 in accordance with the control signals received from the video data output timing generator section 33.

Each of these analog amplifiers 34*a* causes the polarity of a voltage that is applied to the pixel 7 to be reversed every single frame. Each analog amplifier 34*a* has a stationary electric current of approximately 0.01 mA constantly flowing therethrough so that its output capability is ensured. Therefore, the output amplifier circuit 34 can be said to be an output circuit through which a stationary electric current flows. It should be noted that the number of analog amplifiers 34*a* and the number of data signal lines 5 do not necessarily have to be identical to each other.

(Timing Controller 10)

As shown in FIG. 1, the timing controller 10 is provided on a control substrate 13, and is communicably connected to the signal line drive circuits 3 and the like through an FPC (flexible printed circuit board) 14. Therefore, the timing controller 10 is provided as a separate entity (in other words, on separate chips) from the signal line drive circuits 3 and the scan line drive circuit 4.

The timing controller 10 receives clock signals and input video sync signals (namely a horizontal sync signal (Hsync) and a vertical sync signal (Vsync)) through the input connector 11, together with video data. The video data, the horizontal and vertical sync signals, and the clock signals are collectively referred to as "input video signal". This input video signal comes from an external device (e.g., a DVD player, a broadcast receiving device, or the like) communicably connected to the input connector 11.

The timing controller 10 generates, in accordance with the horizontal and vertical sync signals thus received, sync signals and clock signals on the basis of which the circuits of the display device 1 operate in synchronization with each other. Then, the timing controller 10 outputs these sync and clock signals together with the video data as a video signal to each of the three signal line drive circuits 3 simultaneously. Therefore, the timing controller 10 functions as a data signal transfer section that receives video data from an outside source and transfers the video data to each of the signal line drive circuits 3.

Further, the timing controller 10 outputs the sync and clock signals thus generated to the scan line drive circuit 4.

Further, the timing controller 10 defines, in accordance with the clock and sync signals received from an outside source, a scan period during which a data signal is supplied to each of the pixels 7 linked to a selected scan signal line 6 and a non-scan period during which the data signal is not supplied to any one of the pixels 7. Then, the timing controller 10 transmits, to each of the signal line drive circuits 3, an operation discriminant signal (pause control signal) that causes the video signal receiving circuit 31 to be underrun during at least part of the non-scan period thus defined.

The operation discriminant signal can be said to be a signal for switching between a pause state in which the video signal receiving circuit 31 is underrun and an operating state to which the video signal receiving circuit 31 recovers from the pause state. The timing controller 10 outputs the operation discriminant signal thus generated to each of the three video signal receiving circuits 31 simultaneously. This configuration allows the three video signal receiving circuits 31 to be paused and driven in synchronization with each other.

Thus, in addition to functioning to receive horizontal and vertical synch signals and clock signals as an an input video signal from an outside source, the timing controller 10 functions as an operation discriminant signal generation section that generates an operation discriminant signal. The timing at which an operation discriminant signal is generated (turned ON/OFF) is determined in accordance with horizontal and vertical synch signals and clock signals. Therefore, since the timing controller 10, which receives horizontal and vertical synch signals and clock signals, generates an operation discriminant signal, the generation of an operation discriminant signal can be achieved with a simple configuration.

It should be noted that the operation discriminant signal needs only be a signal capable of causing the video signal receiving circuit 31 to switch between an operating state and a pause state. For example, the video signal receiving circuit 31 may be brought into a pause state by not transmitting the operation discriminant signal to the video signal receiving circuit 31. Further, the operation discriminant signal may be achieved in the form of a combination of two types of signal, namely (i) a recover control signal (operation control signal) that causes the video signal receiving circuit 31 to recover from a pause state and (ii) a pause control signal that causes the video signal receiving circuit 31 to shift from an operating state to a pause state.

In the following, it is assumed that the operation discriminant signal is a signal having two levels of voltage, namely a H value and a L value, that in the case of reception of a H-value operation discriminant signal, the video signal receiving circuit 31 operates, and that in the case of reception of a L-value operation discriminant signal, the video signal receiving circuit 31 pauses. That is, the operation discriminant signal in the present embodiment can be said to be a single signal into which the recover control signal and the pause control signal have been combined. The operation discriminant signal is the recover control signal when the operation discriminant signal has a H value, and the operation discriminant signal is the pause control signal when the operation discriminant signal has a L value.

Further, a state in which the operation discriminant signal has a H value is expressed as "the operation discriminant signal is ON", and a state in which the operation discriminant signal has a L value is expressed as "the operation discriminant signal is OFF".

It should be noted that the timing controller 10 may transmit an operation discriminant signal as a recover control signal to each of the video signal receiving circuits 31 of the plurality of signal line drive circuits 3 separately (at different timings). However, the timing at which the operation discriminant signal is turned ON (the operation discriminant signal is transmitted) is set so that all of the video signal receiving circuits 31 rise before a scan period starts.

This configuration makes it possible to, in a case where there are provided a plurality of signal line drive circuits 3, cause the timing of generation of a rush current at the time of recovery of each of the plurality of signal line drive circuits 3 to vary among the plurality of signal line drive circuits 3.

It should be noted when the three video signal receiving circuits differ from each other in terms of the timing at which the operation discriminant signal is turned ON, the three video signal receiving circuits 31 rise at different timings from each other. In this case, too, the three video signal receiving circuits 31 can be synchronized in accordance with sync and clock signals that are transmitted to the signal line drive circuits 3.

(Power Supply Generation Circuit 12)

The power supply generation circuit 12 generates voltage necessary for the circuits in the display device 1 to operate, and outputs the voltage to the circuits of the display device 1.

(Scan Period and Non-scan Period)

In driving the display panel 2, the display device 1, as described above, divides a single vertical period or a set of vertical periods into a scan period and a non-scan period. The term "scan period" here means a period during which a data signal is supplied to the pixels 7 linked to a given scan signal line 6, and the term "non-scan period" here means a remainder of a single vertical period or a set of vertical periods that does not include the scan period. It should be noted that a single vertical period is defined in accordance with a vertical sync signal inputted from an outside source.

Figure 3:
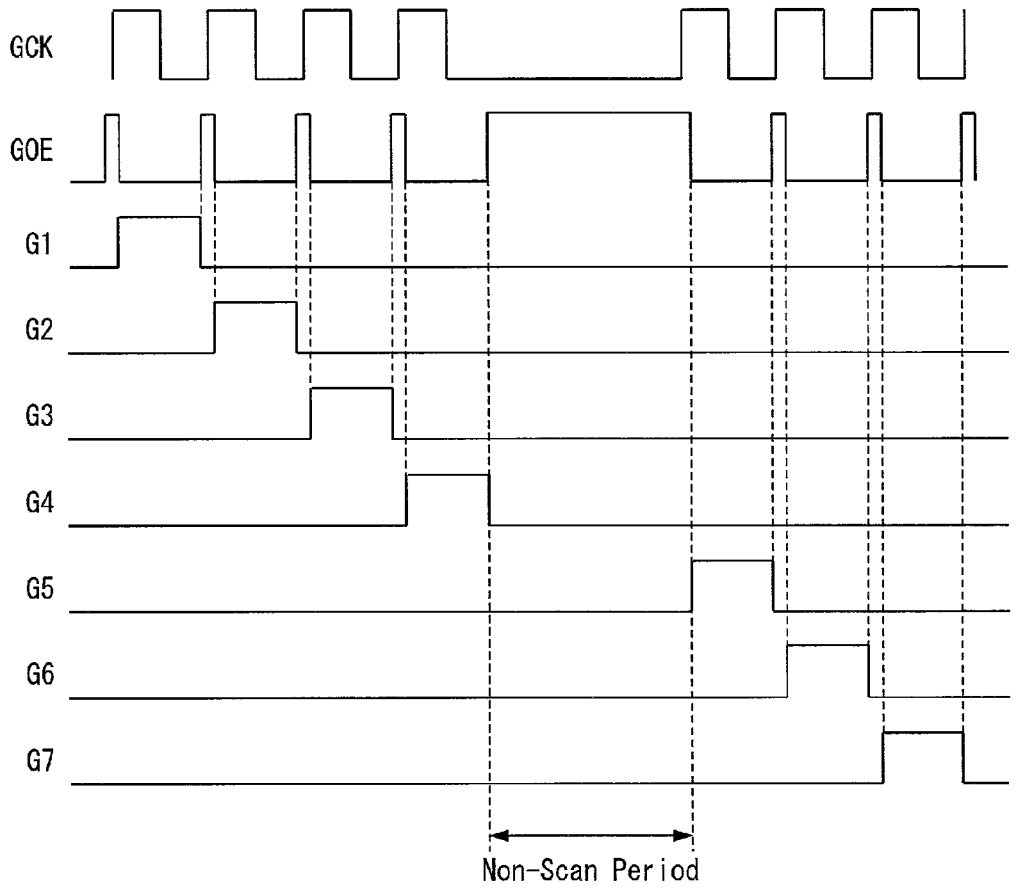
FIG. 3 is a diagram is a diagram for explaining a method for setting up a non-scan period in a single vertical period in the display device.

FIG. 3 is a diagram for explaining a method for setting up a non-scan period in a single vertical period. As shown in FIG. 3, a non-scan period can be set up by adjusting the intervals of oscillation of a GCK signal (gate clock signal) and a GOE signal (gate output enable signal) that are outputted from the timing controller 10 in order to control the scan line drive circuit 4.

In the example shown in FIG. 3, a predetermined time interval is provided between a point in time where a scan signal was outputted to the fourth scan signal line (G4) and a point in time where a scan signal is outputted to the fifth scan signal line (G5), and it is this time interval that serves as a non-scan period. That is, the non-scan period is a period during which none of the scan signal lines is selected.

The example shown in FIG. 3 is merely an example, and the method for setting up a non-scanning period is not limited to the aforementioned method. Further, the length of a non-scan period and the position of a non-scan period in a single vertical period are not particularly limited. A non-scan period is a given period in a single vertical period. For example, a non-scan period may start at a point in time immediately after completion of scanning of a single frame or may be a short time after the completion. Further, a non-scan period may not necessarily end at a point in time where a single vertical period ends, and may end before the single vertical period ends.

(Operating Period and Pause Period of the Video Signal Receiving Circuit 31)

A period during which the video signal receiving circuit 31 is in a pause state is referred to as "pause period", and a period other than the pause period is referred to as "operating period". A pause period is at least some period included in a non-scan period of the display device 1. That is, a non-scan period and a pause period coincide each other, or part of a non-scan period may be a pause period.

Further, the video signal receiving circuit 31 does not necessarily have to stop running during a pause period. The effect of lowering power consumption can be brought about simply by causing the video signal receiving circuit 3 to be underrun during a pause period.

An operation discriminant signal that is generated by the timing controller 10 is a signal for the video signal receiving circuit 31 to switch between a pause state and an operating state. While this operation discriminant signal is ON, the video signal receiving circuit 31 is in an operating state. Since the timing controller 10 defines a scan period and a non-scan period, the timing controller 10 needs only determine the ON/OFF timing of an operation discriminant signal with reference to the scan period and the non-scan period it defined.

That is, a process in the timing controller 10 includes the steps of: (a) defining, in accordance with sync signals received from an outside source, a non-scan period during which none of the scanning signal lines 6 is selected; and (b) transmitting, to each of the signal line drive circuits 3, a pause control signal that causes each of the video signal receiving circuits 31 to be underrun during at least part of the non-scan period defined in step (a).

It should be noted that each of the video signal receiving circuits 31 may have provided therein (i) a video signal receiving section for receiving a video signal and (ii) a receiving circuit control section. The receiving circuit control section receives an operation discriminant signal and controls operation and pausing of the video signal receiving section in accordance with the operation discriminant signal thus received. In this case, as soon as the operation discriminant signal is turned ON, the receiving circuit control section performs a process of causing the video signal receiving section to operate. Further, as soon as the operation discriminant signal is turned OFF, the receiving circuit control section performs a process of causing the video signal receiving section to pause.

(Effects of the Display Device 1)

With the above configuration, pausing and driving of the video signal receiving circuits 31 mounted on separate chips from the timing controller 10 can be achieved by outputting an operation discriminant signal from the timing controller 10 to each of the video signal receiving circuits 31. This causes driving of the video signal receiving circuits 31 to be paused during at least part of a non-scan period, so that the amount of electric power that is consumed by the display device 1 can be reduced.

Further, since it is not necessary for the signal line drive circuits to measure the length of a pause period, it is no longer necessary to provide the signal line drive circuits with a built-in clock generation circuit. This makes it possible to achieve pausing and driving of the video signal receiving circuits with simple circuits.

It is conceivable that the ON/OFF control of the video signal receiving circuits is executed by a command from a serial interface or the like (SPI or I2C). However, since a serial interface and a video signal system are basically out of synchronization with each other, a complicated configuration is required for transmitting and receiving commands in accordance with a scan period and a pause period and reflecting the commands in internal operation.

Therefore, as mentioned above, it is preferable that driving of the video signal receiving circuits 31 be controlled by an operation discriminant signal.

[Embodiment 2]

Another embodiment of the present invention is described below with reference to FIGS. 4 and 5. It should be noted that members similar to those of Embodiment 1 are given the same reference signs, and as such, are not described below.

Figure 4:
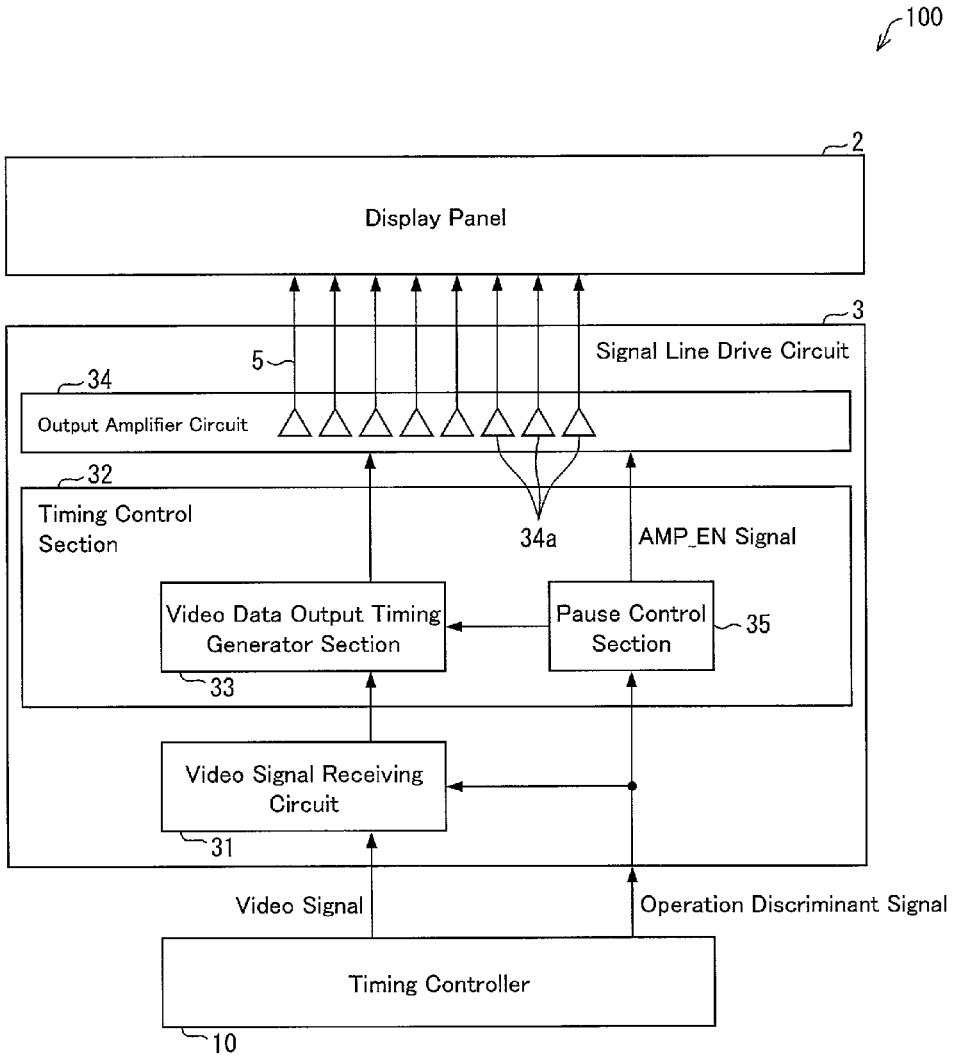
FIG. 4 is a diagram showing a configuration of a display device according to another embodiment of the present invention.

FIG. 4 is a diagram showing a configuration of a display device 100 of the present embodiment. As shown in FIG. 4, the display device 100 has a pause control section (output circuit control section) 35 included in each timing control section 32.

In the display device 100, the timing controller 10 outputs an operation discriminant signal to the pause control sections 35 as well as the video signal receiving circuits 31.

Each of the pause control sections 35 outputs, to its corresponding output amplifier circuit 34, a AMP_Enable signal (hereinafter referred to as "AMP_EN signal") that causes the analog amplifiers 34*a* of the output amplifier circuit 34 to switch between a pause state and an operating state. A pause state of the analog amplifiers 34*a* is a state in which the analog amplifiers 34*a* in underrun. An operating state of the analog amplifiers 34*a* is a state to which the analog amplifiers 34*a* recover from the pause state. Further, a period during which the analog amplifiers 34*a* are in a pause state is referred to as "amplifier pause period", and a period during which the analog amplifiers 34*a* are in an operating state is referred to as "amplifier operating period".

More specifically, the pause control section 35 switches the AMP_EN signal to a H value upon receiving an operation discriminant signal, and switches the AMP_EN signal to a L value as soon as the operation discriminant signal is turned OFF. The analog amplifiers 34*a* operate when the AMP_EN signal is at a H value, and pause when the AMP_EN signal is at a L value. That is, the pause control section 35 causes, in accordance with an operation discriminant signal, the output amplifier circuit 34 to operate and pause.

In an amplifier pause period, it is not always necessary to cause all of the analog amplifiers 34*a* included in the output amplifier circuit 34 to completely stop running, but it is possible to underrun only some of the analog amplifiers 34*a*. That is, in an amplifier pause period, it is only necessary to at least partially underrun the output amplifier circuit 34, which brings about an effect of lowering power consumption. Causing all of the analog amplifiers 34*a* to pause is desirable because doing so makes it possible to best reduce power consumption.

It is also possible to directly input an AMP_EN signal from the timing controller 10 to the output amplifier circuit 34. In this case, the timing controller 10 functions as an output circuit control section that causes the output amplifier circuit 34 to be underrun.

However, the generation of an AMP_EN signal from an operation discriminant signal eliminates the need to separately provide a signal line through which the AMP_EN signal is transmitted to the output amplifier circuit 34, thus making it possible to reduce the number of terminals of the timing controller 10 and of the signal line drive circuit 3. Therefore, it is preferable to generate an AMP_EN signal from an operation discriminant signal in the pause control section 35.

It should be noted that an AMP_EN signal is also outputted from the pause control section 35 to the video data output timing generator section 33 so as to be utilized for control of output of video data.

(Relationship between an Operation Discriminant Signal and Other Signals)

An operation discriminant signal is inputted to the video signal receiving circuit 31, and is also inputted to the pause control section 35. This operation discriminant signal causes the video signal receiving circuit 31 to be controlled to be driven, and an AMP_EN signal is generated in accordance with the operation discriminant signal. FIG. 5 is a timing chart showing a comparison between the signal waveform of an operation discriminant signal and the signal waveforms of other signals.

Figure 5:
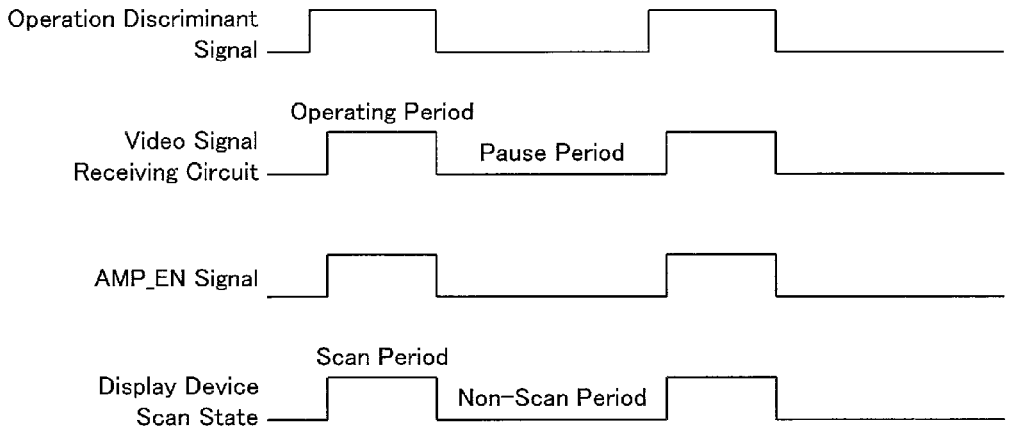
FIG. 5 is a timing chart showing a comparison between the signal waveform of an operation discriminant signal and the signal waveforms of other signals.

It is preferable that as shown in FIG. 5, an operation discriminant signal be turned ON a short time before a scan period starts. That is, it is preferable that before a scan period starts, the timing controller 10 transmit, to each of the video signal receiving circuits 31, an operation discriminant signal (recover control signal) that causes the video signal receiving circuit 31 to recover from a pause state.

When the video signal receiving circuit 31 is activated by turning ON the operation discriminant signal, a certain amount of time is required until the video signal receiving circuit 31 becomes able to normally operate. Turning ON the operation discriminant signal and starting the next scan period at the same timing may cause such a problem as destabilization of the state of a signal that is outputted from the output amplifier circuit 34 to the data signal lines 5. This may cause an unintended voltage to be applied to the pixels 7.

Therefore, it is preferable that the display device 100 be configured such that a timing at which the operation discriminant signal is turned ON is earlier than a timing at which the next scan period starts (a point of time at which an operating period starts). This causes the next scan period to start after the video signal receiving circuit 31 recovers from a pause state and becomes stable, thus making it possible to apply a normal voltage to the pixels 7. The same applies to the display device 1.

Further, turning ON/OFF the operation discriminant signal causes the analog amplifiers 34*a* to switch between an operating state and a pause state. Specifically, the pause control section 35 switches the AMP_EN signal to a H value upon receiving the operation discriminant signal (as soon as the operation discriminant signal is turned ON), and switches the AMP_EN signal to a L value as soon as the operation discriminant signal is turned OFF.

In the timing chart shown in FIG. 5, there is a time lag between the point in time where the operation discriminant signal was turned ON and the point in time where the AMP_EN signal switches to a H value. This time lag occurs because the AMP_EN signal does not switch to a H value soon after the operation discriminant signal is turned ON.

In this sense, too, as mentioned above, it is preferable that a timing at which the operation discriminant signal is turned ON be set earlier than a timing at which the next scan period starts (i.e., a point of time at which an operating period starts). This configuration causes the next scan period to start after the analog amplifiers 34*a* recovers from a pause state and becomes stable, thus making it possible to apply a normal voltage to the pixels 7.

It should be noted that the pause control section 35 may separately output a signal for causing the analog amplifiers 34*a* to operate and a signal for causing the analog amplifiers 34*a* to pause.

(Effects of the Display Device 100)

As described above, the display device 100 performs pausing and driving of the output amplifier circuits 34 in addition to pausing and driving of the video signal receiving circuits 31. This makes it possible to lower power consumption of a display device more effectively than in a case where pausing and driving of only the video signal receiving circuits 31 are performed.

[Embodiment 3]

Still another embodiment of the present invention is described below with reference to FIGS. 6 and 7. It should be noted that members similar to those of Embodiments 1 and 2 are given the same reference signs, and as such, are not described below.

Figure 6:
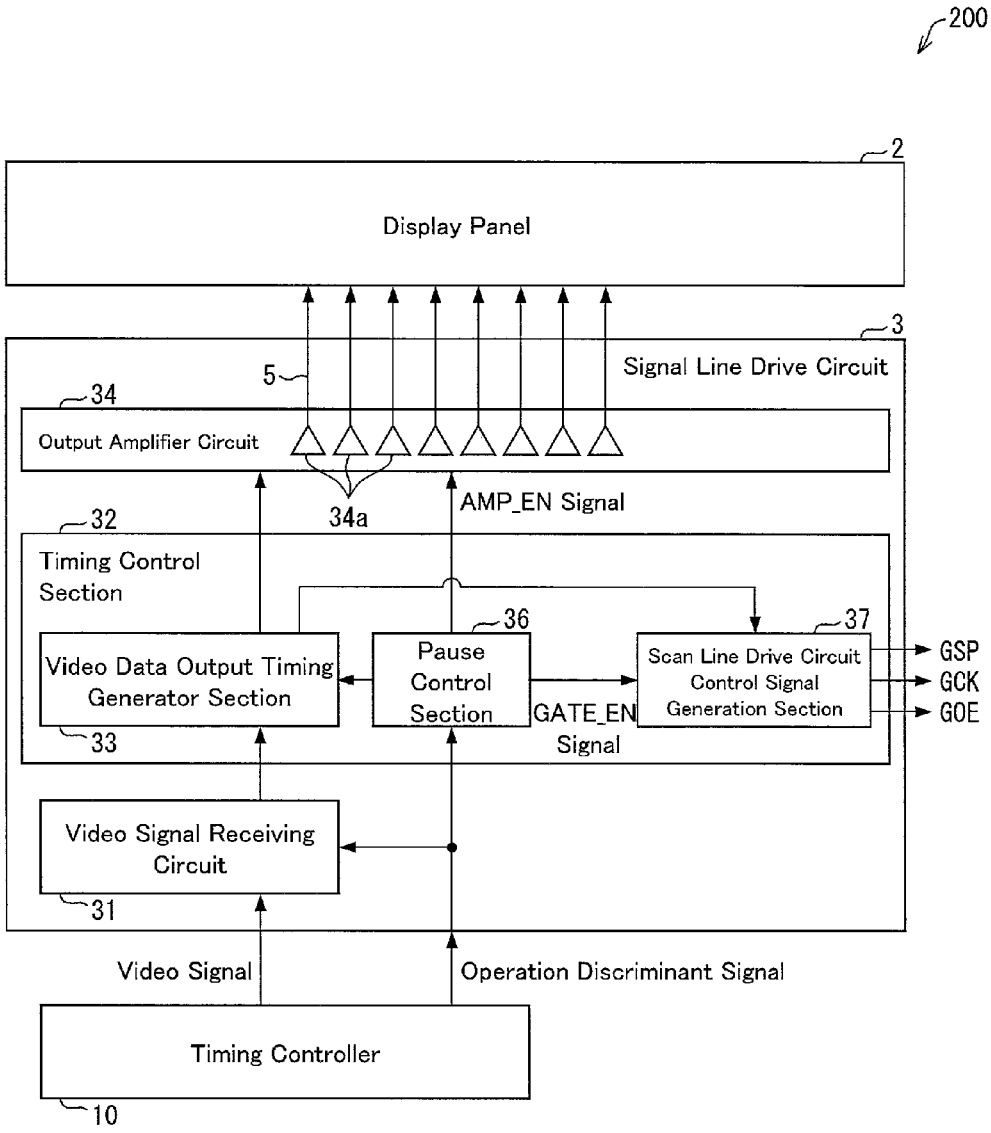
FIG. 6 is a diagram showing a configuration of a display device according to still another embodiment of the present invention.

FIG. 6 is a diagram showing a configuration of a display device 200 of the present embodiment. As shown in FIG. 6, the display device 2 has a pause control section (scan line drive circuit control section) 36 and a scan line drive circuit control signal generation section (scan line drive circuit control section) 37 included in each timing control section 32.

In addition to the function of the pause control section 35, the pause control section 36 generates a GATE_Enable signal (hereinafter referred to as "GATE_EN signal") that causes the scan line drive circuit 4 to switch between a pause state and an operating state. Then, the pause control section 36 transmits the GATE_EN signal thus generated to the scan line drive circuit control signal generation section 37.

More specifically, the pause control section 36 switches the GATE_EN signal from a L value to a H value upon receiving an operation discriminant signal (as soon as the operation discriminant signal is turned ON), and switches the GATE_EN signal to a L value as soon as the operation discriminant signal is turned OFF. The scan line drive circuit 4 normally operates when the GATE_EN signal is at a H value, and pauses when the GATE_EN signal is at a L value. That is, the pause control section 36 causes, in accordance with an operation discriminant signal, the scan line drive circuit 4 to operate and pause.

The video data output timing generator section 33 generates, in accordance with a video signal received by the video signal receiving circuit 31, control signals (a horizontal sync signal, a vertical sync signal, and clocks (dot clocks)) on which timing control of the scan line drive circuit 4 is based. Then, the video data output timing generator section 33 outputs the control signal thus generated to the scan line drive circuit control signal generation section 37.

The scan line drive circuit control signal generation section 37 generates, in accordance with the GATE_EN signal received from the pause control section 36 and the control signals received from the video data output timing generator section 33, a timing control signal in accordance with which the timing at which the scan line drive circuit 4 outputs a scan signal to the display panel 2 is controlled. This timing control signal contains GSP (gate start pulse signal), GCK (gate clock signal), and GOE (gate output enable signal). Therefore, in the present embodiment, the timing controller 10 does not execute control on the scan line drive circuit 4.

The scan line drive circuit control signal generation section 37 outputs the timing control signal thus generated to the scan line drive circuit 4.

It should be noted here that when the GATE_EN signal is at a H value, the scan line drive circuit control signal generation section 37 places the timing control signal (such as GSP) in a state of oscillation during a normal scan period, and when the GATE_EN signal is at a L value, the scan line drive circuit control signal generation section 37 places the timing control signal in a state of output which, as shown in FIG. 3, indicates a fixed (constant-level) waveform corresponding to a non-scan period. This configuration causes the scan line drive circuit 4 to normally operate when the GATE_EN signal is at a H value and to pause when the GATE_EN signal is at a L value. Conversely, it is possible to cause the scan line drive circuit 4 to pause when the GATE_EN signal is at a H value and to operate when the GATE_EN signal is at a L value.

It should be noted that in a case where a more highly functional scan line drive circuit is employed, such a configuration is possible that a GATE_EN signal is transmitted directly to the scan line drive circuit 4.

In this way, the pause control section 36 and the scan line drive circuit control signal generation section 37 function as a scan line drive circuit control section that switch, in accordance with an operation discriminant signal, between a pause state in which the scan line drive circuit 4 is underrun and an operating state to which the scan line drive circuit 4 recovers from the pause state.

(Relationship between an Operation Discriminant Signal and a GATE_EN Signal)

Figure 7:
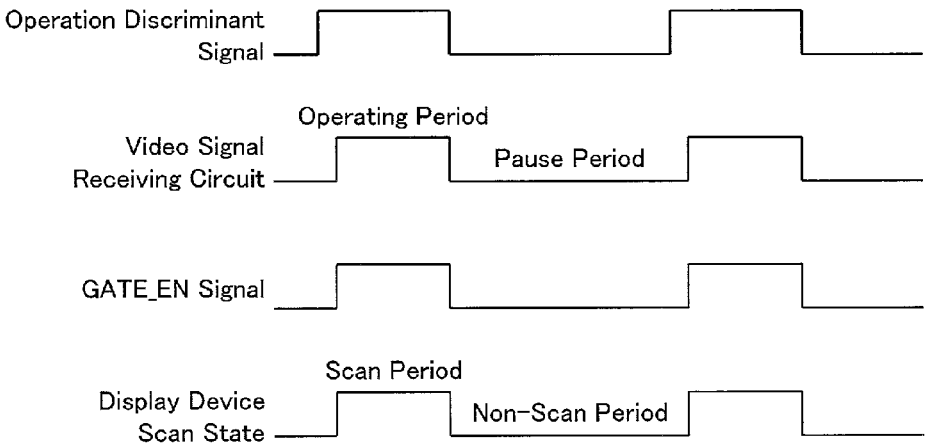
FIG. 7 is a timing chart showing a comparison between the signal waveform of an operation discriminant signal and the signal waveform of a GATE_EN signal.

FIG. 7 is a timing chart showing a comparison between the signal waveform of an operation discriminant signal and the signal waveform of a GATE_EN signal. The relationship between the operation discriminant signal and the GATE_EN signal as shown in FIG. 7 is the same as the relationship between the operation discriminant signal and the AMP_EN signal as shown in FIG. 5. That is, a pause period of the output amplifier circuit 34 and a pause period of the scan line drive circuit 4 coincide with each other.

The display device 200 defines a scan period and a non-scan period by turning ON/OFF an operation discriminant signal. Therefore, the timing controller 10 defines the ON/OFF timing of an operation discriminant signal so that scan and non-scan periods corresponding to an input video image are achieved.

(Effects of the Display Device 200)

As described above, by including the pause control section 36 and the scan line drive circuit control signal generation section 37, the display device 200 can perform pausing and driving of the scan line drive circuit 4 by the signal line drive circuit 3 in addition to pausing and driving of the output amplifier circuit 34. This makes it unnecessary to provide a control signal wire from the timing controller 10, thus making it possible to reduce FPC width.

[Embodiment 4]

Still another embodiment of the present invention is described below with reference to FIGS. 8 and 11. It should be noted that members similar to those of Embodiments 1 to 3 are given the same reference signs, and as such, are not described below.

In the following description, the display devices 1, 100, and 200 are each configured such that the timing controller 10 transmits a differential clock signal and a differential data signal as well as an operation discriminant signal to each of the video signal receiving circuits 31. The differential clock signal is equivalent to the aforementioned clock signals. Further, the differential data signal is equivalent to the aforementioned sync and video data signals. That is, the aforementioned video signal is inputted as a differential signal to each of the video signal receiving circuits 31.

A differential signal is constituted by a pair of signals, namely a positive signal and a negative signal. The positive signal and the negative signal are out of phase by approximately 180 degrees. A potential difference between these two signals is a signal level.

Use of a differential signal can make signal amplitude smaller than a single-ended signal, thus making it possible to achieve a higher data transmission speed. Further, a differential signal brings about a beneficial effect of having resistance to common mode noise.

The following describes the timing of input of signals to each of the video signal receiving circuits 31 and the states of the signals both at the time of recovery of the video signal receiving circuit 31 from a pause state and at the time of shift of the video signal receiving circuit 31 to a pause state.

The following description is based on the premise that a clock signal and a data signal are differential signals. However, a signal other than a differential signal may be used as a clock signal and/or a data signal as long as it is a signal capable of achieving a signal state corresponding to a differential Low input state.

(At the Time of Recovery from a Pause State)

(First Example)

Figure 8:
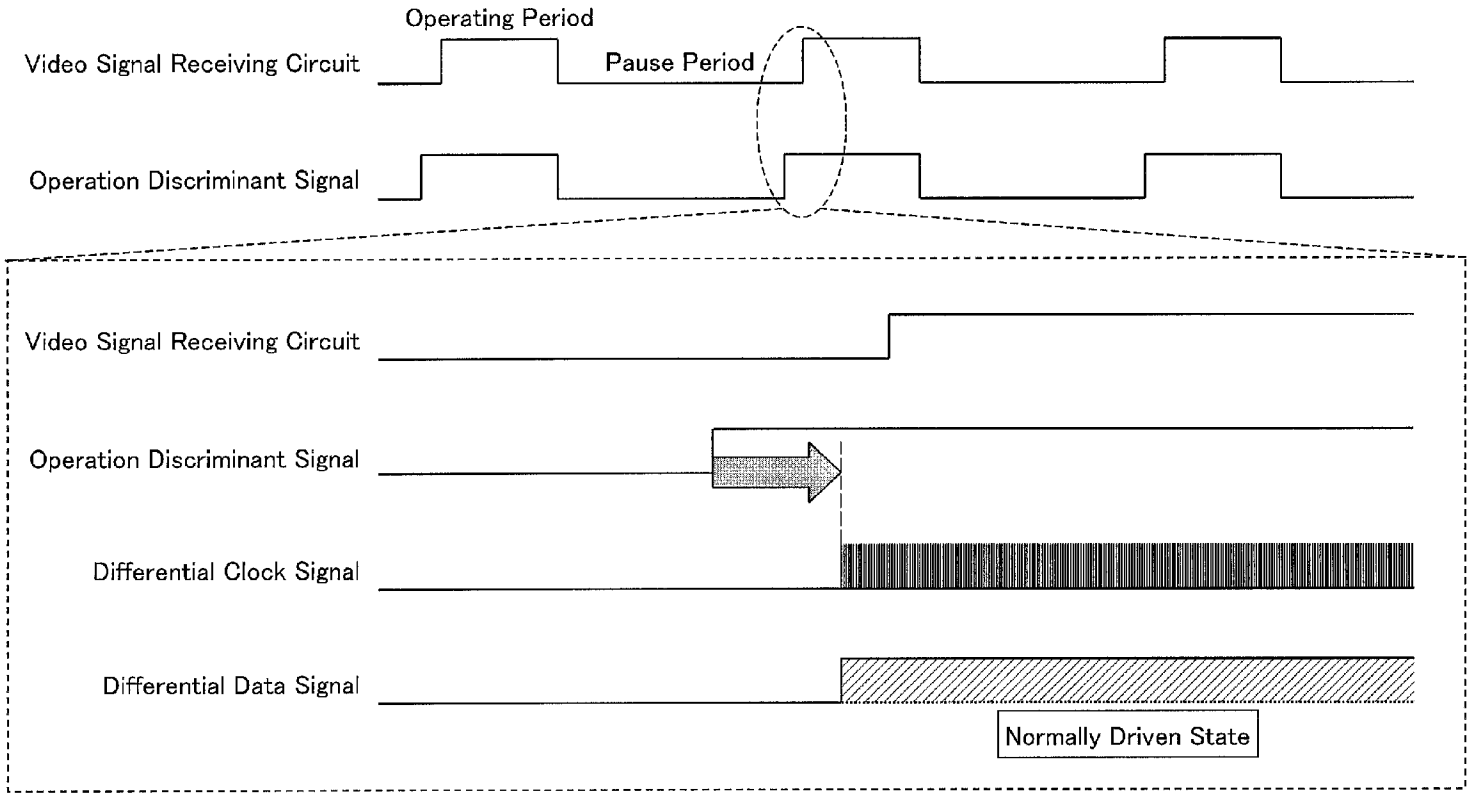
FIG. 8 is a timing chart showing that at a point in time where a video signal receiving circuit that is in a pause state is receiving an operation discriminant signal, the video signal receiving circuit does not receive a differential clock signal or a differential data signal.

FIG. 8 is a timing chart showing that at a point in time where a video signal receiving circuit 31 that is in a pause state is receiving an operation discriminant signal, the video signal receiving circuit 31 does not receive a differential clock signal or a differential data signal.

It is preferable that as shown in FIG. 8, a video signal receiving circuit 31 that is in a pause state receive an operation discriminant signal that causes the video signal receiving circuit 31 to recover from the pause state, the operation discriminant signal being received before the timing of start of reception of specific signals (i.e., a differential clock signal and a differential data signal) that are received in an operating period. That is, the differential clock signal and the differential data signal are transmitted from the timing controller 10 after a predetermined period of time has elapsed since the operation discriminant signal was turned ON. However, the differential clock signal and the differential data signal are inputted to the video signal receiving circuit 31 at a point in time where or a short time before a scan period starts.

This configuration, in which plural types of signal as well as an operation discriminant signal are inputted at the same time to a video signal receiving circuit 31 that is in a pause mode, can reduce the possibility of a problem in the video signal receiving circuit 31.

It should be noted that such a configuration is possible that only either the differential clock signal or the differential data signal is not inputted to the video signal receiving circuit 31 at a point in time where the operation discriminant signal is turned ON. However, the aforementioned effects are surely brought about by, preferably, not inputting both the differential clock signal and the differential data signal at the same time as the operation discriminant signal.

[Second Example]

Figure 9:
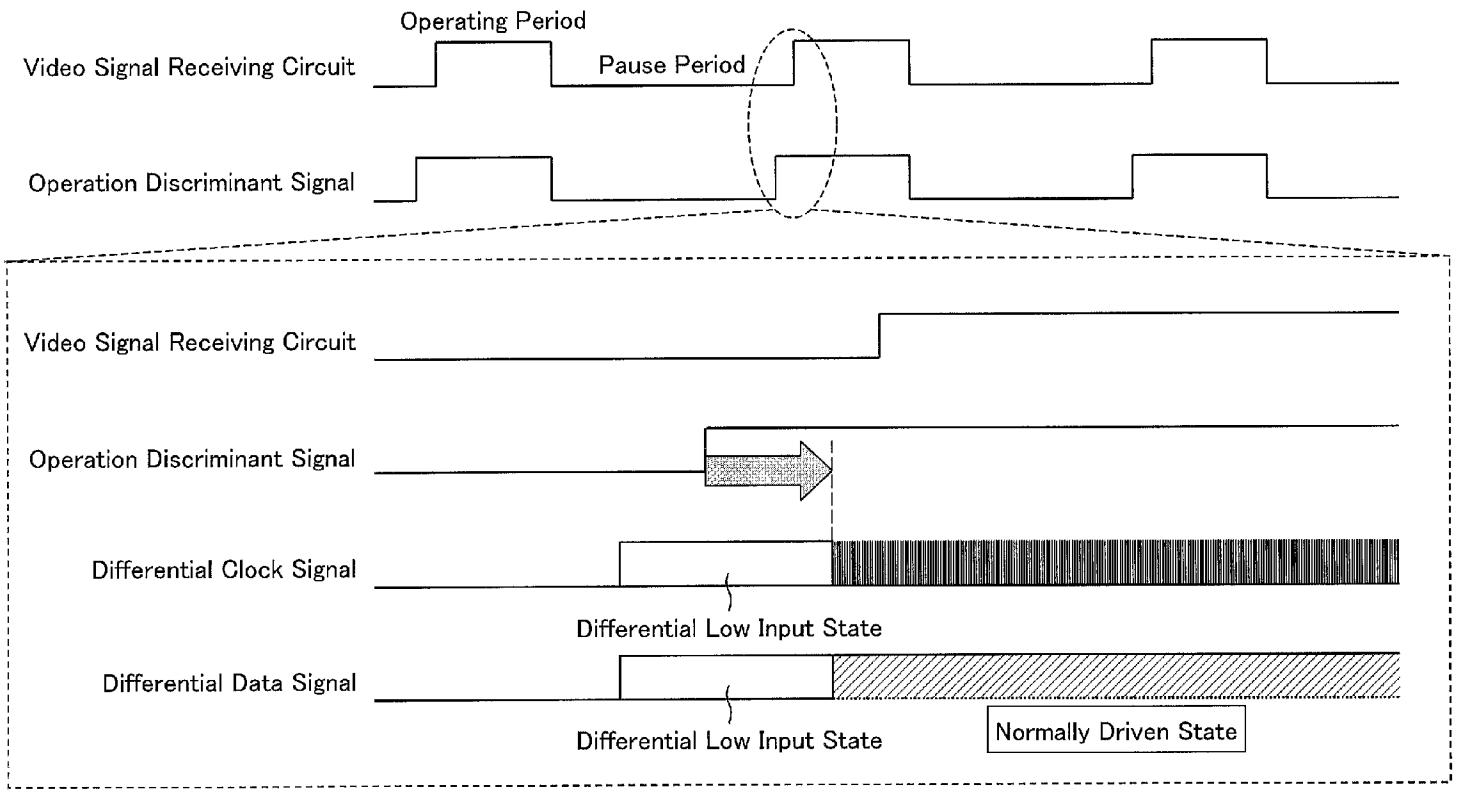
FIG. 9 is a timing chart showing that at a point in time where a video signal receiving circuit that is in a pause state is receiving an operation discriminant signal, a differential clock signal and a differential data signal are in a Low input state.

FIG. 9 is a timing chart showing that at a point in time where a video signal receiving circuit 31 that is in a pause state is receiving an operation discriminant signal, a differential clock signal and a differential data signal are in a Low input state.

It should be noted here that the term "differential Low input state" refers to a state in which a potential difference between the two signals of each of the differential signals (the differential clock signal and the differential data signal) is fixed at a predetermined level or lower. That is, the differential Low input state is a state in which the positive and negative signals both have a High level or both have a Low level (are both fixed to a Low level).

Further, the normally driven state of the differential signals means a state in which the positive and negative signals each independently vary from a Low level to a High level and a potential difference therebetween is given a predetermined meaning.

As shown in FIG. 9, a video signal receiving circuit 31 that is in a pause state receives the differential clock signal and the differential data signal as well as the operation discriminant signal at the time of recovery. It is preferable that the differential clock signal and the differential data signal are in a Low input state at this point in time. In other words, it is preferable that in receiving an operation discriminant signal that causes recovery from a pause state, a video signal receiving circuit 31 that is in a pause state receive a differential clock signal and a differential data signal (specific signals) that it receives during an operating period, with the differential clock signal and the differential data signal in a differential Low input state.

This configuration, in which signals at high voltage levels as well as an operation discriminant signal are inputted to a video signal receiving circuit 31 that is in a pause mode, can reduce the possibility of a problem in the video signal receiving circuit 31.

In this example, the timing of reception of the differential clock signal and the differential data signal in a differential Low input state may be at the same time as the timing of reception of the operation discriminant signal or may be earlier than the timing at which the operation discriminant signal is turned ON.

Further, the period of time during which to receive the differential clock signal and the differential data signal in a differential Low input state needs only be appropriately set according to the characteristics etc. of the circuit. However, the differential clock signal and the differential data signal are inputted to the video signal receiving circuit 31 in a normally driven state at a point in time where or a short time before a scan period starts.

Further, such a configuration is also possible that only either the differential clock signal or the differential data signal is received in a differential Low input state at at point in time where the operation discriminant signal is turned ON. However, the aforementioned effects are surely brought about by, preferably, receiving both the differential clock signal and the differential data signal in a differential Low input state.

(At the Time of Shift to a Pause State)

(First Example)

Figure 10:
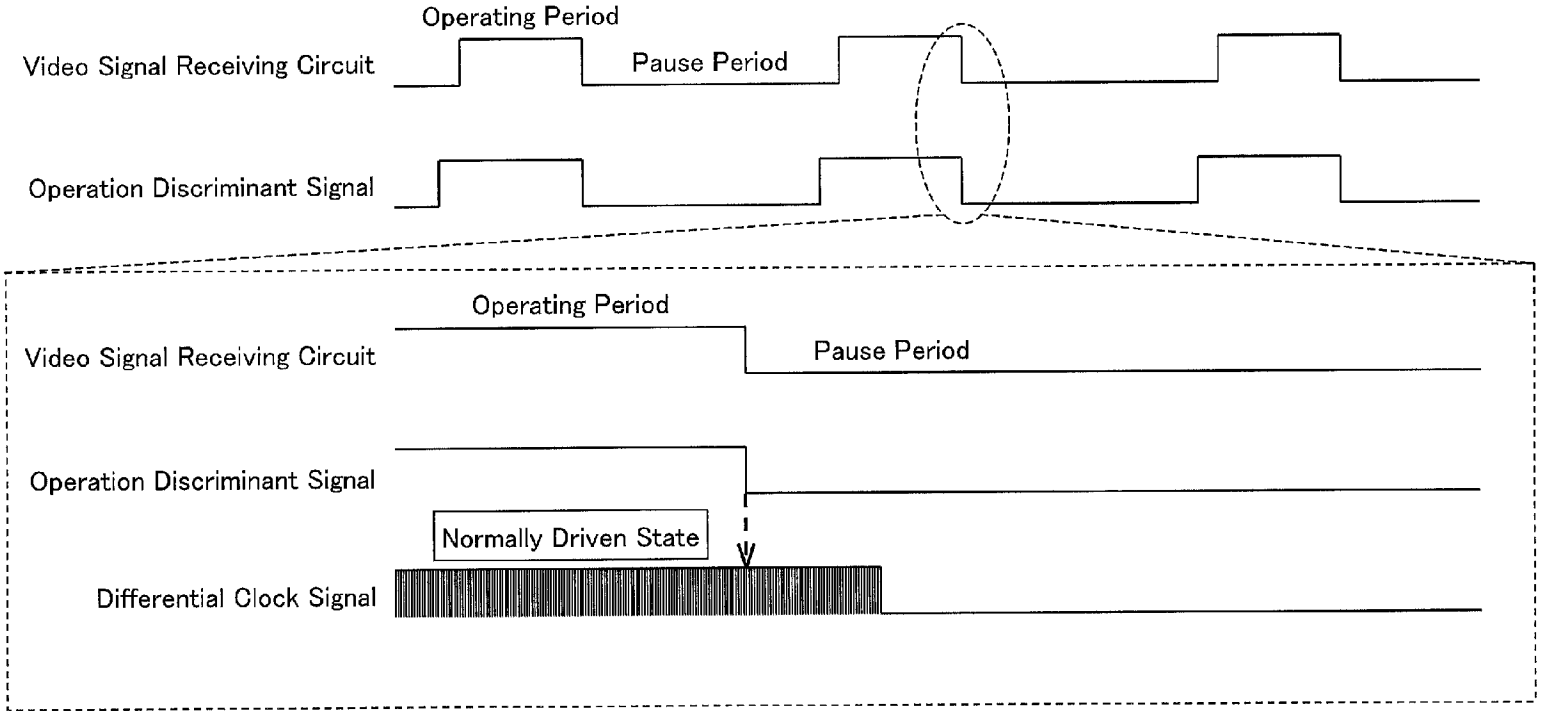
FIG. 10 is a timing chart showing that a differential clock signal is normally driven until a predetermined period of time has elapsed since an operation discriminant signal was turned OFF.

FIG. 10 is a timing chart showing that a differential clock signal is normally driven until a predetermined period of time has elapsed since an operation discriminant signal was turned OFF. It is preferable that as shown in FIG. 10, the video signal receiving circuit 31 continuously receive the differential clock signal in a normally driven state until a predetermined period of time has elapsed since the operation discriminant signal was turned OFF. That is, it is preferable that the timing of stoppage of transmission of the differential clock signal from the timing controller 10 lag the timing at which the operation discriminant signal is turned OFF.

The predetermined period of time is for example approximately several tens of clock counts, although it varies according to the circuit characteristics of the video signal receiving circuit 31.

It is possible to stop the transmission of the differential clock signal at a point in time where the operation discriminant signal is turned OFF; however, it is preferable to cause the circuits in the signal line drive circuit 3 to stop running in sequence instead of stopping running all at once. This configuration can reduce the possibility of a problem at the time of recovery from a pause state, as compared to a case where the transmission of the differential clock signal is abruptly stopped.

[Second Example]

Figure 11:
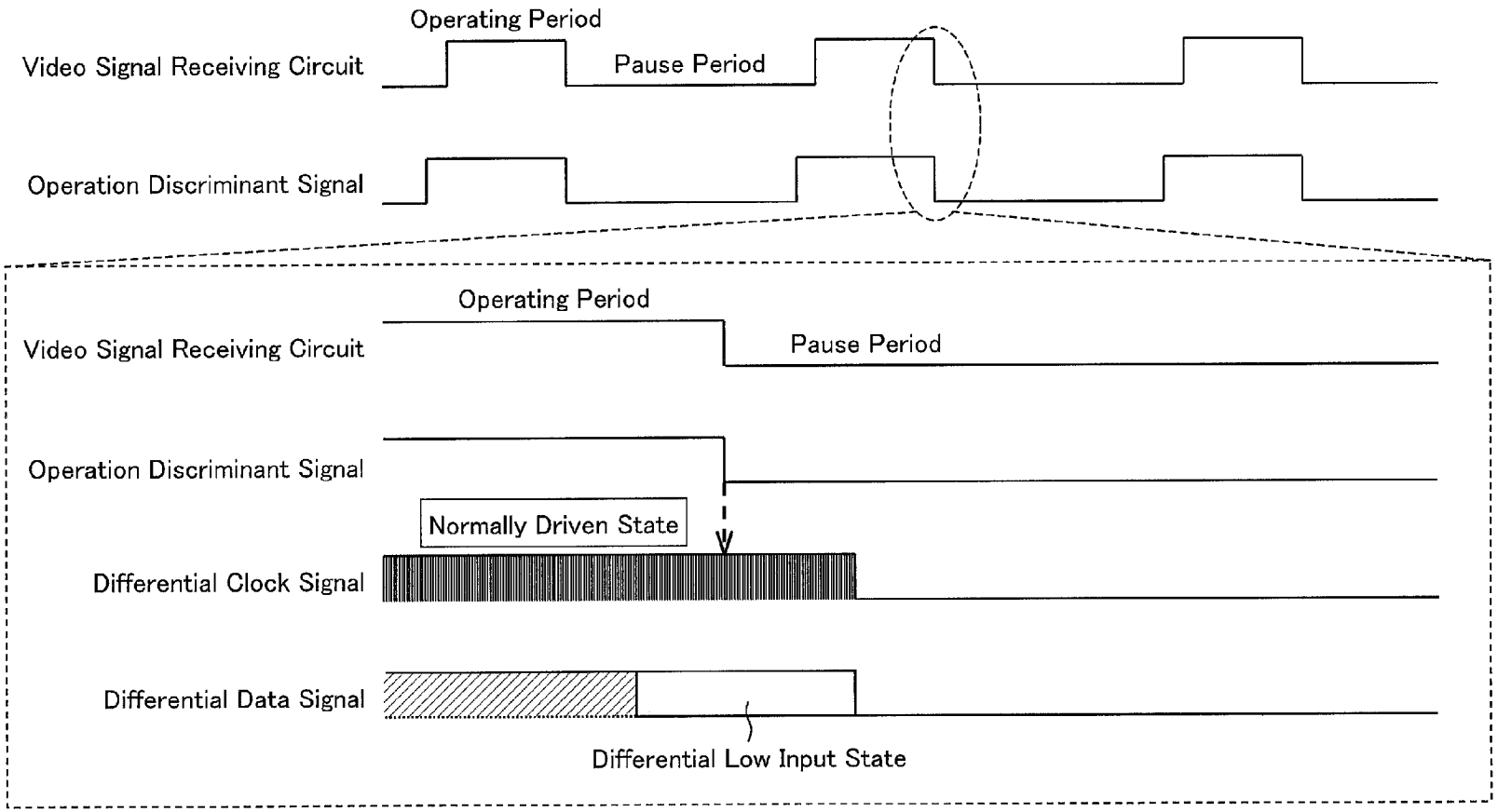
FIG. 11 is a timing chart showing that a differential clock signal is normally driven until a predetermined period of time has elapsed since an operation discriminant signal was turned OFF and that a differential data signal is inputted in a Low input state during a predetermined period of time including the point in time where the operation discriminant signal was turned OFF.

FIG. 11 is a timing chart showing that a differential clock signal is normally driven until a predetermined period of time has elapsed since an operation discriminant signal was turned OFF and that a differential data signal is inputted in a Low input state during a predetermined period of time including the point in time where the operation discriminant signal was turned OFF.

In this example, as shown in FIG. 11, the differential clock signal is inputted to the video signal receiving circuit 31 in a normally driven state until a predetermined period of time has elapsed since the operation discriminant signal was turned OFF, as in First Example.

In addition, the differential data signal is inputted in a differential Low input state during a period of time including the point in time where the operation discriminant signal was turned OFF. The predetermined period of time needs only be appropriately set according the circuit characteristics of the video signal receiving circuit 31.

In a case where a data signal at a high voltage level was received at a point in time where the video signal receiving circuit 31 shifts to a pause state, there is a possibility of such a problem that the video signal receiving circuit 31 may not return to normal in the next operating period. The configuration of this example can reduce such a possibility.

[Additional Matters]

Further, the display device is preferably configured such that: the at least one signal line drive circuit comprises a plurality of signal line drive circuits; and the timing control section simultaneously transmits the pause control signal to each of the receiving circuits of the plurality of signal line driver circuits.

The foregoing configuration makes it possible to, in a case where the at least one signal line drive circuit comprises a plurality of signal line drive circuits, control pausing by synchronizing the plurality of signal line drive circuits with each other.

Further, the display device is preferably configured such that: the at least one signal line drive circuit comprises a plurality of signal line drive circuits; and the timing control section separately transmits, to each of the receiving circuits of the plurality of signal line driver circuits, a recovery control signal that causes the receiving circuits to recover from a pause state in which they are underrun.

The foregoing configuration makes it possible to, in a case where there are provided a plurality of signal line drive circuits, cause the timing of generation of a rush current at the time of recovery of each of the plurality of signal line drive circuits to vary among the plurality of signal line drive circuits.

Further, the display device is preferably configured such that before a scan period starts during which the data signal is supplied to the pixels, the timing control section transmits, to the at least one signal line drive circuit, a recovery control signal that causes the receiving circuit to recover from a pause state in which it is underrun.

There is a possibility that the receiving circuit may not recover from the pause state soon after receiving the recovery control signal. The foregoing configuration transmits the recovery control signal before the start of the scan period in consideration of a time lag it takes for the receiving circuit to recover, thereby allowing the scan period to start with the receiving circuit having recovered.

This makes it possible to prevent a problem from occurring in a display of a video image due to the start of a scan period with the receiving circuit having not completely recovered.

Further, the display device is preferably configured such that the at least one signal line drive circuit includes (i) an output circuit which outputs the data signal to the pixels and (ii) an output circuit control section which, in accordance with the pause control signal, causes the output circuit to be underrun.

The foregoing configuration makes it possible to cause the output circuit as well as the receiving circuit to be underrun, thus making it possible to further lower power consumption. Further, the foregoing configuration, which transmits a recovery control signal to the at least one signal line drive circuit before a scan period starts, makes it possible to ensure sufficient time for the output circuit to return to a normal function.

Further, the display device is preferably configured such that the at least one signal line drive circuit includes a scan line drive circuit control section which, in accordance with the pause control signal, causes the scan line drive circuit to be underrun.

The foregoing configuration makes it possible to cause the scan line drive circuit as well as the receiving circuit to be underrun, thus making it possible to further lower power consumption.

Further, the display device is preferably configured such that when the receiving circuit is in a pause state in which it is underrun, the receiving circuit receives, from the timing control section, a recovery control signal that causes the receiving circuit to recover from the pause state, the recovery control signal being received before a timing at which the receiving circuit starts receiving a specific signal that it receives during an operating period to which it has recovered from the pause state.

The foregoing configuration, which causes a specific signal as well as a recovery control signal to be inputted to a receiving circuit that is in a pause state, can reduce the possibility of a problem in the receiving circuit.

Further, the display device is preferably configured such that when the receiving circuit is in a pause state in which it is underrun and receives, from the timing control section, a recovery control signal that causes the receiving circuit to recover from the pause state, the receiving circuit receives a specific signal that it receives during an operating period to which it has recovered from the pause state, with the specific signal fixed to a Low level.

The phrase "fixed to a Low level" here means a state, unlike normal operating state, in which the voltage level of the signal is fixed at a predetermined voltage or lower. In the case of input of a differential signal, the phrase means a state in which a potential difference between two signals of the differential signal is fixed at a predetermined level or lower.

The foregoing configuration, which causes a specific signal as well as a recovery control signal to be inputted as a normal operating state to a receiving circuit that is in a pause state, can reduce the possibility of a problem in the receiving circuit.

Further, the display device is preferably configured such that the specific signal is a clock signal, the data signal, or both.

Further, the display device is preferably configured such that the receiving circuit continuously receives a clock signal until a predetermined period of time has elapsed since the receiving circuit shifted to a pause period in which it is underrun.

The foregoing configuration makes it possible to cause the circuits in the at least one signal line drive circuit to stop running in sequence instead of stopping running all at once. This makes it possible reduce the possibility of a problem in the at least one signal line drive circuit at the time of recovery from a pause state, as compared to a case where the transmission of the clock signal is abruptly stopped.

Further, the display device is preferably configured such that during a predetermined period of time including a point in time where the receiving circuit shifted to a pause period in which it is underrun, the receiving circuit receives the data signal with the data signal fixed at a Low level.

In a case where a data signal not fixed at a Low level but kept in a normal operating state was received at a point in time where the receiving circuit shifts to a pause state, there is a possibility of such a problem that the receiving circuit may not return to normal in the next operating period. The foregoing configuration can reduce such a possibility.

Further, the display device is preferably configured such that the clock signal or the data signal is inputted as a differential signal to the receiving circuit.

Use of a differential signal can make signal amplitude smaller than a single-ended signal, thus making it possible to achieve a higher data transmission speed. Further, a differential signal brings about a beneficial effect of having resistance to common mode noise.

Further, a display device of the present invention may be a liquid crystal display device or may be an organic electroluminescent display device.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A display device according to the present invention is widely applicable as various display devices such as liquid crystal display devices, organic EL display devices, and electronic paper.

REFERENCE SIGNS LIST

1 Display device
3 Signal line drive circuit
4 Scan line drive circuit
7 Pixel
10 Timing controller (timing control section)
31 Video signal receiving circuit
34 Output amplifier circuit (output circuit)
35 Pause control section (output circuit control section)
36 Pause control section (scan line drive circuit control section)
37 Scan line drive circuit control signal generation section (scan line drive circuit control section)
100 Display device
200 Display device

The invention claimed is:

1. A display device comprising:

a scan line drive circuit which line-sequentially selects from among a plurality of scan signal lines;

at least one signal line drive circuit which includes a receiving circuit that receives a data signal, and which sequentially supplies the data signal to pixels linked to a scan signal line selected by the scan line drive circuit; and a timing control section which defines, in accordance with sync signals received from an outside source, a non-scan period during which none of the scan signal lines is selected, and which transmits, to the at least one signal line drive circuit, a pause control signal, wherein the at least one signal line drive circuit and the timing control section are provided as separate entities;

the at least one signal line drive circuit includes (i) an output circuit which outputs the data signal to the pixels and (ii) an output circuit control section which, in accordance with the pause control signal, causes the output circuit to be underrun;

the output circuit includes a plurality of analog amplifiers, each of the plurality of analog amplifiers has a constant electric current flowing therethrough; the pause control signal causes the constant electric current flowing through at least some of the plurality of analog amplifiers to be stopped during at least part of the non-scan period to cause the output circuit to be underrun;

when the receiving circuit is in a pause state in which it is underrun and the receiving circuit receives, from the timing control section, a recovery control signal that causes the receiving circuit to recover from the pause state, the receiving circuit receives a specific signal that the receiving circuit receives during an operating period in which the receiving circuit has recovered from the pause state, with the specific signal fixed to a Low level; and the specific signal includes a clock signal.

2. The display device as set forth in claim 1, wherein:

the at least one signal line drive circuit comprises a plurality of signal line drive circuits; and the timing control section simultaneously transmits the pause control signal to each of the receiving circuits of the plurality of signal line driver circuits.

3. The display device as set forth in claim 1, wherein:

the at least one signal line drive circuit comprises a plurality of signal line drive circuits; and the timing control section separately transmits, to each of the receiving circuits of the plurality of signal line driver circuits, a recovery control signal that causes the receiving circuits to recover from a pause state in which they are underrun.

4. The display device as set forth in claim 1, wherein before a scan period starts during which the data signal is supplied to the pixels, the timing control section transmits, to the at least one signal line drive circuit, a recovery control signal that, causes the receiving circuit to recover from a pause state in which it is underrun.

5. The display device as set forth in claim 1, wherein the at least one signal line drive circuit includes a scan line drive circuit control section which, in accordance with the pause control signal, causes the scan line drive circuit to be underrun.

6. The display device as set forth in claim 1, wherein during a predetermined period of time including a point in time where the receiving circuit shifted to a pause period in which it is underrun, the receiving circuit receives the data signal with the data signal fixed at a Low level.

7. The display device as set forth in claim 1, wherein the clock signal or the data signal is inputted as a differential signal to the receiving circuit.

8. The display device as set forth in claim 1, wherein the display device is a liquid crystal display device.

9. The display device as set forth in claim 1, wherein the display device is an organic electroluminescent display device.

10. The display device as set forth in claim 1, wherein the pause control signal causes the constant electric current flowing through all of the plurality of analog amplifiers to be stopped during the at least part of the non-scan period.

11. The display device as set forth in claim 1, wherein the specific signal further includes both the clock signal and also the data signal.

12. A method for driving a display device including:

a scan line drive circuit which line-sequentially selects from among a plurality of scan signal lines;

at least one signal line drive circuit which includes a receiving circuit that receives a data signal, and which sequentially supplies the data signal to pixels linked to a scan signal line selected by the scan line drive circuit;

a timing control section which defines, in accordance with clock and sync signals received from an outside source, a non-scan period during which none of the scan signal lines is selected, and the at least one signal line drive circuit and the timing control section being provided as separate entities, the method comprising:

(a) a defining step in which the timing control section defines the non-scan period in accordance with the clock and sync signals received from the outside source; and (b) a transmitting step in which the timing control section transmits, to the at least one signal line drive circuit, a pause control signal, wherein the at least one signal line drive circuit includes (i) an output circuit which outputs the data signal to the pixels and (ii) an output circuit control section which, in accordance with the pause control signal, causes the output circuit to be underrun;

the output circuit includes a plurality of analog amplifiers, each of the plurality of analog amplifiers has a constant electric current flowing therethrough; and the pause control signal causes the constant electric current flowing through at least some of the plurality of analog amplifiers to be stopped during at least part of the non-scan period to cause the output circuit to be underrun;

when the receiving circuit is in a pause state in which it is underrun and the receiving circuit receives, from the timing control section, a recovery control signal that causes the receiving circuit to recover from the pause state, the receiving circuit receives a specific signal that the receiving circuit receives during an operating period in which the receiving circuit has recovered from the pause state, with the specific signal fixed to a Low level; and the specific signal includes a clock signal.

13. The method for driving a display device as set forth in claim 12, wherein the pause control signal causes the constant electric current flowing through all of the plurality of analog amplifiers to be stopped during the at least part of the non-scan period.

14. The method for driving a display device as set forth in claim 12, wherein the specific signal further includes both the clock signal and also the data signal.

* * * * *